United States Patent [19]

Peterson

[11] 3,975,056

[45] Aug. 17, 1976

[54] LONGWALL CANTED DRUM MINING MACHINE

[75] Inventor: Carl R. Peterson, Boxford, Mass.

[73] Assignee: Rapidex, Inc., Gloucester, Mass.

[22] Filed: Feb. 11, 1974

[21] Appl. No.: 441,418

[52] U.S. Cl. ..... 299/42; 175/338; 175/53; 299/11; 299/86

[51] Int. Cl.[2] ..... E21C 27/24

[58] Field of Search ..... 299/11, 42–54, 299/86, 87; 175/338, 53

[56] References Cited

UNITED STATES PATENTS

| | | | |
|---|---|---|---|
| 1,388,545 | 8/1921 | Bohan | 299/87 X |
| 2,583,458 | 1/1952 | Wylam | 299/86 X |

FOREIGN PATENTS OR APPLICATIONS

| | | | |
|---|---|---|---|
| 1,173,049 | 7/1964 | Germany | 299/86 |
| 974,669 | 3/1961 | Germany | 299/11 |
| 1,079,801 | 8/1967 | United Kingdom | 299/86 |

*Primary Examiner*—Ernest R. Purser

[57] ABSTRACT

A side excavating machine comprising a rotatably driven cylindrical drum adapted to advance generally endwise along a pre-existing working face, but angled so that trailing portions of the drum project beneath the plane of the pre-existing face. The drum has a distribution of rock cutting rollers on its cylindrical surface which are freely rotatable about rolling axes which are fixed in a predetermined relation to the axis of the drum, defining a small forward skew angle. The cylindrical drum is rotatably mounted by bearings on a frame which advances along the working face, with the drum axis lying at a small acute angle to the direction of advance so that trailing portions of the drum excavate rock as the frame advances along the face. The major component of rock-cutting forces thereby applied to the drum is normal to the direction of advance of the frame, and there are means to provide side reaction force to the frame corresponding to this major component of rock-cutting forces. The fixed axis skewed rollers in rolling action upon the rock are adapted to generate a force assisting in the forward advance of the cutting rollers. Embodiments shown include a single such rotatable drum with the frame provided with a tractive device, and a pair of such drums mounted at opposite tilted angles. A bed mechanism which retains cuttings also provides the reactive forces in another embodiment.

8 Claims, 17 Drawing Figures

LONGWALL CANTED DRUM MINING MACHINE

This invention relates to improved mining machinery and methods and to in situ extraction of values, including in particular petroleum deposits as found in oil shale and copper deposits as found in the Nonesuch shales in the state of Michigan, U.S.A.

According to one aspect of the invention a side excavating machine is provided, comprising the combination of an elongated cylindrical drum having a distribution of freely rotatable rock cutting rollers on its cylindrical surface and a frame adapted to advance into a tunnel being excavated in a direction parallel to a side of the tunnel. The drum is rotatably mounted by bearings carried by the frame and is rotatably driven relative to the frame. The axis of the cylinder lies at an acute angle to the direction of advance of the frame such that with the leading edge of the drum contacting the tunnel side, the trailing portions of the drum project beneath the original tunnel surface to excavate rock as the frame progresses parallel to the tunnel side.

Certain preferred embodiments of the invention feature a single such rotatable drum carried on the frame, the frame provided with a tractive device for advancing the frame along the tunnel; skew of the axis of rotation of the rotatable rock cutting rollers relative to the axis of the drum enabling the cutters themselves to generate advancing forces for the cutting action; backfilling means for depositing broken rock in situ as the excavation proceeds; and reactive members disposed to engage the side formed by the backfilled rock, to hold the cutting drum in place against the tunnel side as excavation proceeds; and means to reverse the tilt of the drum which, with reversal of the direction of advance of the frame, enables excavation in the reverse direction.

According to another preferred embodiment the machine has a pair of such rotatable drums mounted upon the frame, the drum being mounted at opposite tilted angles relative to the line of advance of the frame, preferably with the axis of the cutter rollers skewed relative to the axis of the drum to generate self-advancing forces, preferably with means to increase the spacing between the pair of drums thereby to enable a second tunnel widening pass following a first pass, and preferably the drums so mounted and constructed that each drum, by its engagement with a working side of the tunnel, provides a reactive force for holding the other drum in position, in a self-balanced relation.

These and numerous other features of the machines will be understood from the description below.

Another aspect of the invention features the method of preparing rock for in situ extraction of a constituent of a rock formation comprising breaking the rock in situ in a manner to form a narrow, horizontal flow-directing chamber in the rock, filled with fluid-permeable broken rock. The method includes the steps, in a horizontal, elongated tunnel, of excavating rock progressively from one vertical side wall of the tunnel, progressively removing a portion of the thus excavated rock from the tunnel and progressively depositing in the tunnel a major portion of the broken rock on the opposite vertical side of the tunnel to provide a progressively growing fill of broken rock extending from floor to ceiling, thus back filling the chamber, the back filled rock serving to progressively support the roof of the chamber as the tunnel is enlarged.

Another aspect of the invention features the formation of a series of underground chambers filled with broken rock constructed to direct fluid for in situ extraction of values. A preferred embodiment features the formation of adjacent chambers separated by webs of unexcavated rock, including the steps during excavation of each chamber, of progressively removing a portion of the broken rock from the chamber at one side and depositing in the chamber a major portion of the broken rock on the opposite side of the chamber at the site of excavation to provide a progressively growing depth of broken rock back-filling the chamber as the excavation proceeds, the broken rock of each chamber serving to reinforce the web of unexcavated rock separating the chambers as the excavation proceeds. Another feature is the use of an excavating machine in a series of horizontal aligned passes through a tunnel to form horizontally elongated chambers, during excavation of each chamber, progressively removing a portion of the broken rock from the chamber at one side and depositing in the chamber a major portion of the broken rock on the opposite side of the chamber at the site of excavation, to provide a growing depth of broken rock back filling the chamber, the excavating machine advancing upon the progressively growing broken rock side (either vertical or bottom side) of the tunnel as the excavation proceeds, and also according to still another aspect of the invention a method of in situ extraction of constituent of a rock formation is provided comprising breaking the rock in situ in a manner to form a series of adjacent, narrow, flow-directing chambers in the rock filled with fluid-permeable broken rock, and then: producing a flow through a first of the chambers of liberating fluid, venting spent liberating fluid which passes through the first chamber through a second chamber while collecting the constituent from the first chamber, and iterating the above steps by producing a flow through the second chamber of liberating fluid in the direction opposite from the venting flow during prior venting through the second chamber, and venting spent liberating fluid which passes through the second chamber through a third chamber while collecting the constituent from the second chamber. Preferred embodiments of this aspect of the invention are employed where the rock contains a petroleum deposit and the liberating fluid comprises hot gas. Preferably in the case of petroleum deposits, a liquid portion of the petroleum is collected at the lower portion of both the first and second chambers during liberating action in the first chamber by gravity flow from broken rock upon which at least part of the liberated portion condenses and preferably air is directed into the first chamber to support combustion of a portion of the petroleum deposit in the broken rock, the hot combustion gases proceeding downstream to act as the liberating fluid.

A preferred embodiment of this aspect invention features during a stage of liberating action near the downstream end of the first chamber, directing the effluent while still hot or active through the second chamber to heat its deposit or cause liberating action and then performing iteration of the process while the broken rock of the second chamber remains heated or activated.

Another preferred embodiment features the liberated fluid being comprised at least in part of a condensable fluid and during the advance of the liberating action the condensable part condenses upon rock in the first chamber downstream of the zone of action, and during a stage of the liberating action near the exit of the first chamber and condensable part being carried with the venting fluid and condensing upon rock in the second chamber. Thereafter, during the iteration, while directing a stream of liberating fluid in the direction opposite of the venting direction through the second chamber, condensate liberated previously from the first chamber and condensed in the second chamber is collected from the second chamber.

These and numerous other objects and features of the invention will be understood from the following detailed description taken in conjunction with the drawings wherein:

FIG. 1 is a plan view of a preferred embodiment especially suitable for horizontal progression of the excavation;

FIG. 1*a* is a force diagram with respect to cutters of the machine of FIG. 1;

FIG. 2 is an end view of the machine of FIG. 1;

FIG. 3, 3*a* and 3*b* are partial end views illustrating the bed advancing sequence of the machine;

FIG. 4 is a perspective view of a preferred embodiment especially suitable for vertical progression of the excavation while

Figure 14:
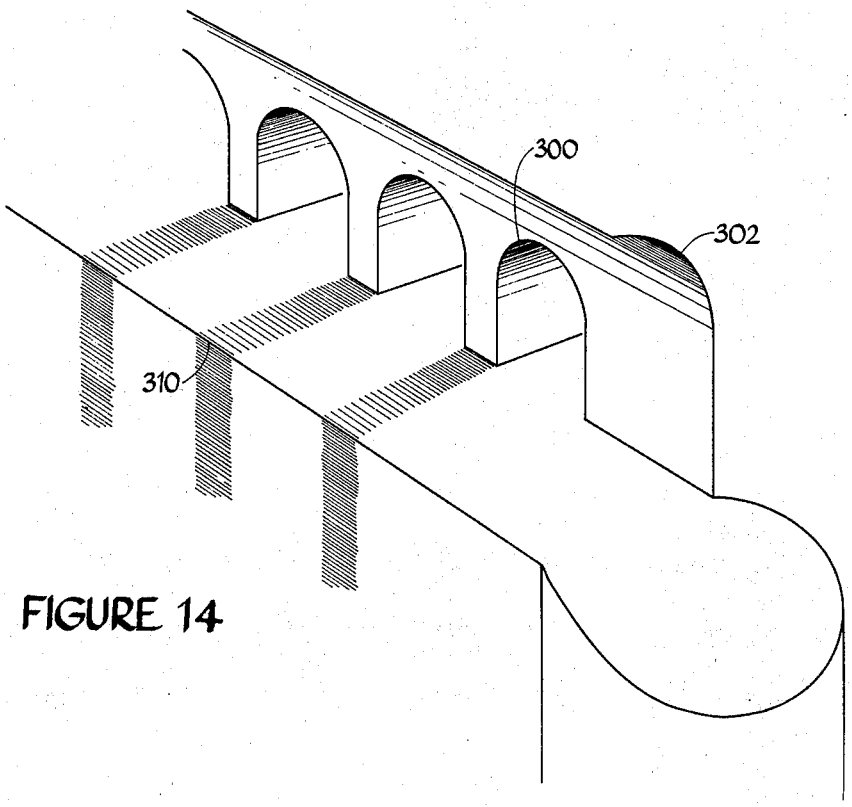

FIG. 14 a perspective view illustrating end tunnel sealing for use in the method.

Figure 1:
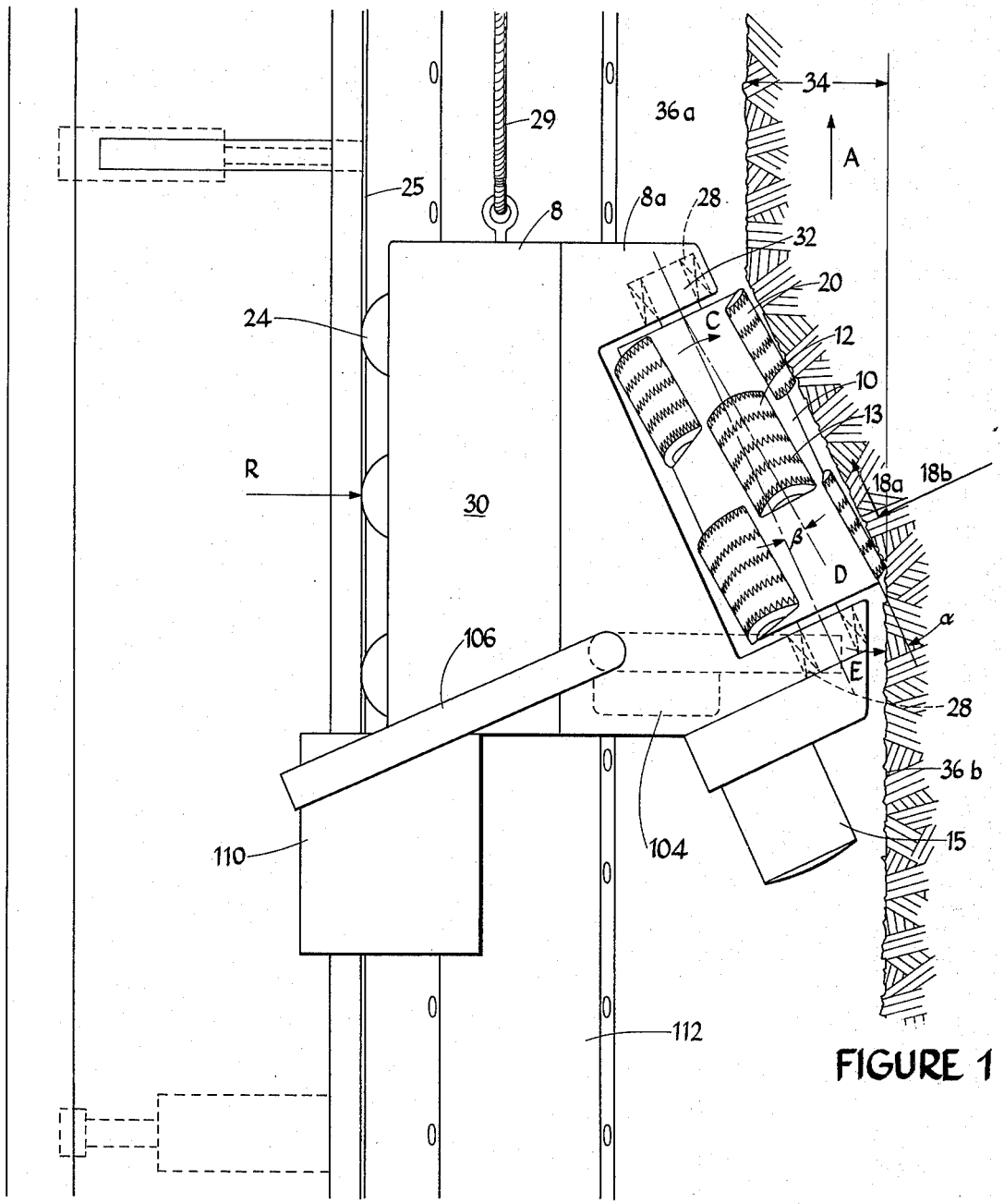
Figure 1A:
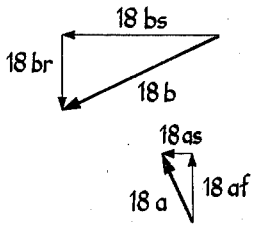

Referring to FIG. 1 a single-sided machine is illustrated, arranged to advance horizontally while excavating a slice out of the side of the tunnel. (It may also be tilted in any other direction to follow an ore vein or to excavate the desired cavity.)

As shown in FIG. 1, the machine consists of a cylindrical, rotating drum 10, carried on a frame indicated generally at 8 and driven by motor and gear set 15 in direction indicated by the arrow C in FIG. 1. Freely rotatable cylindrical cutters, 12, with axis D are arranged on the drum 10. The drum is tilted forward at an angle $\alpha$ to the direction of frame advance A.

Cutters, 12 are toothed cutters carrying tungsten carbide insert teeth 13 (or they may be disc cutters, discussed later). Cutters, 12, are mounted on the drum at a skew angle B relative to the axis E of the drum. B is in the forward direction in the sense that as the cutter 12 is brought into rolling contact with the rock formation at attempts to roll forward on the rock in the advance direction A. This generates a forward force, shown at 18*a*, on the cutter in addition to the normal or penetrating force 18*b*. Cutters rolling on the inclined cylindrical rock surface 20 penetrate this surface and excavate rock in response to the force 18*b*. For proper angles $\alpha$ and B, the forward component 18*af* of force 18*a*, can equal or exceed the rearward component 18*br* of force 18*b*, thus avoiding the need for any external force to cause the drum to advance in the forward direction as it rotates. Typically, $\alpha$ is from 10° to 15° and B from 2° to 5°.

In a single-sided machine the sideways components 18*as* and 18*bs* of forces 18*a* and 18*b*, respectively, must be balanced by a reaction force R applied to the opposite side of the vehicle. Force R is carried through the frame 8 of the vehicle 30 to the drum 10 through large bearings 28 on shafts 32 extending from the drum 10.

Figure 3:
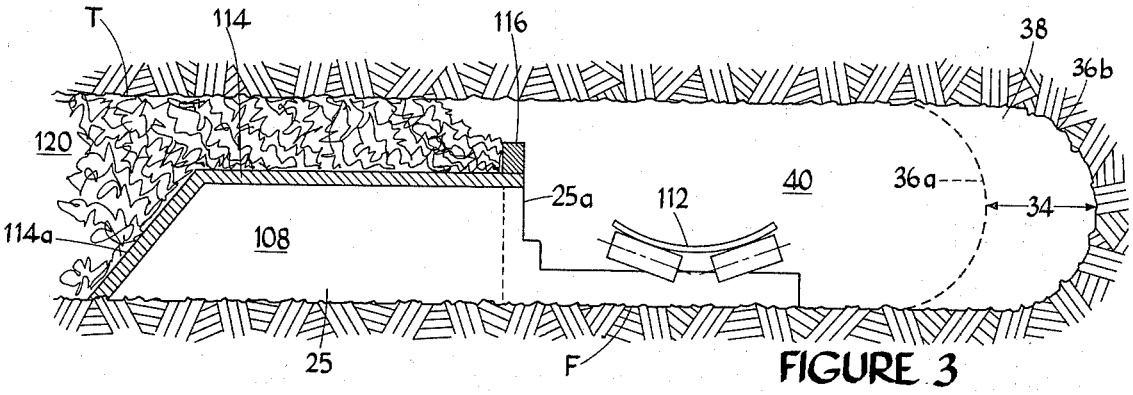

The forward component 18*af* of force 18*a* may exceed the rearward component 18*bf* of force 18*b*, and any excess will assist in advancing the vehicle against the rolling resistance of wheels 24 of the vehicle which ride up on rails 25. However, as a practical matter, since force 18*a* is so far out of line with rolling resistance from wheels 24, it is desirable to also provide additional means to advance the vehicle, here shown as cable 29 extending to a winch not shown. In operation the machine traverses tunnel 40 in the rock while excavating an increment 34 of material from the side surface 36. The cross section of the excavation zone is crescent shaped as shown at 38 in FIG. 3, between the initial tunnel side surface 36*a* and the final side surface 36*b*. Upon reaching the end of the tunnel 40, if it is desired to excavate further material from the surface 36, the machine can be advanced distance 34 and a second pass made.

Figure 2:
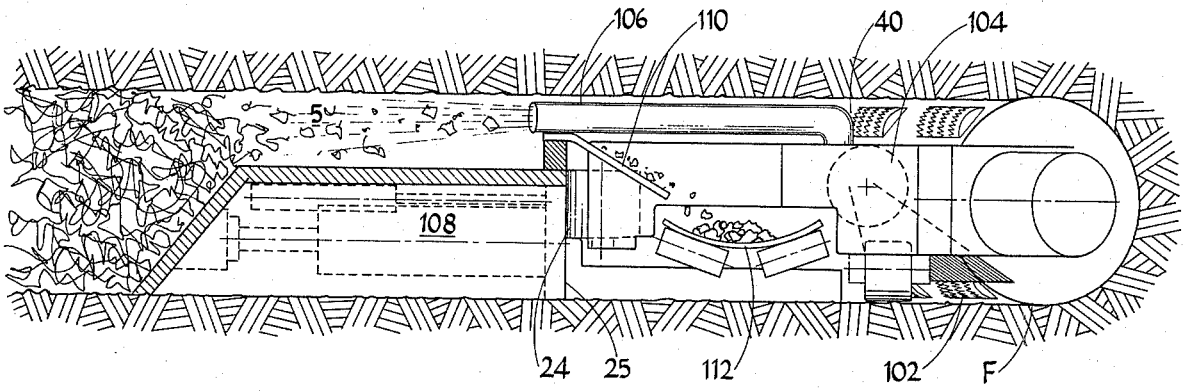

Referring to FIG. 2, a bed mechanism 108 and conveyor 112 extend the full length of the tunnel 40. During the advance of the machine in direction A cuttings 102 from the tunnel floor F are picked up by blower 104 and discharged through tube 106 to space S lying above the bed mechanism 108. Space S is filled with cuttings with excess spilling outward on ramp 110 to conveyor 112 which conveys the cuttings out of the tunnel.

After the machine completes a pass through the tunnel, reaching an access heading (cross tunnel) at the end of the tunnel 40, the bed mechanism is advanced distance 34 (FIG. 3) in preparation for another pass. For this purpose bed mechanism 108 consists of rail member 25, cover 114 and dike member 116.

Figure 3A:
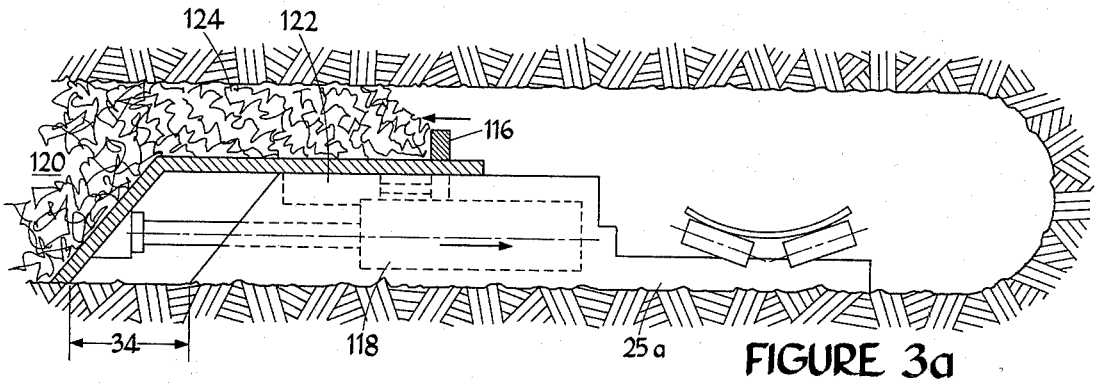

With vehicle 30 removed from the tunnel, rail member 25 (which consists of a number of joined segments, forming effectively a single beam) is advanced distance 34 by a series of hydraulic cylinders 118 which react through cover 114 against previously placed cuttings 120. (See FIG. 3*a*). Simultaneously dike 116 is urged leftward by cylinder 122, compacting cuttings 124, and conveyor 112 is moved rightward by extension 25*a* of the rail 25. Thereupon (FIG. 3*b*) cover 114 is pulled forward by retracting cylinder 118 while dike 116 is further urged leftward, this action serving to deposit cuttings 124 in the open space behind cover 114. Thereupon dike 116 is returned to its rightward position.

Figure 3B:
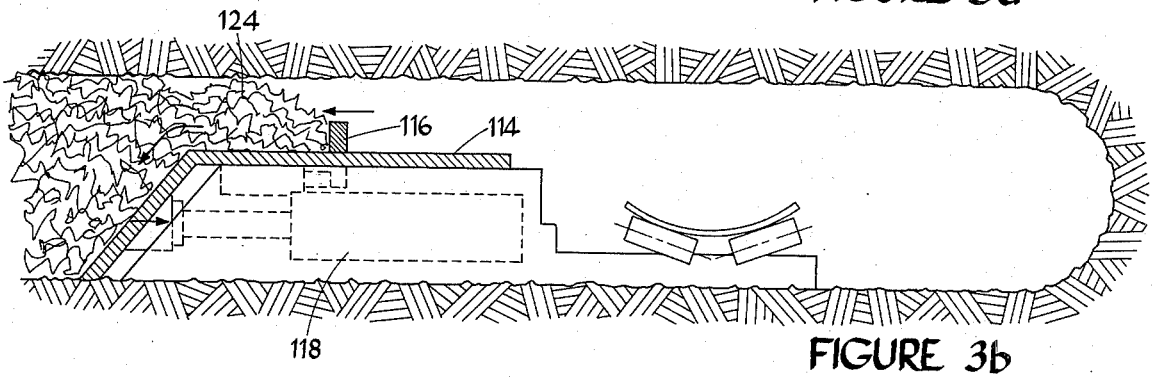

After the position of FIG. 3*b* is attained the machine 30 is re-introduced for a second pass, proceeding in the opposite direction from the previous pass. To enable this reverse motion the drum 10 and the rightward portion 8*a* of frame 8 mounting the drum and its drum are flipped 180° about a horizontal axis perpendicular to axis A of the tunnel and reattached to the leftward portion of the frame.

The design of the cutters to achieve the above-mentioned self-advancing forces is determined in accordance with the principles described in Peterson, Carl R., "Roller Cutter Forces", *Society of Petroleum Engineers of AIME Journal*, Vol. 10, Number 1, March 1970, pp. 57–65.

The machine holds the cutters against the vertical side of the tunnel 20 by reaction against the compacted cuttings 120 engaged by the face 114*a* of the cover 114. These forces are transmitted from cuttings 120, through cover 114, and by butting contact, to and through rail 25 to rail surface 25*a* engaged by wheels 24 of the advancing vehicle. The frame 8 of the vehicle transmits these forces to bearings 28, thence to the drum 10 and the journaled cutters 12 and teeth 13 thereupon, thence to the rock face 20. Rearward, downward slanting of the face 114*a* of the cover serves, via the loading thereupon, to hold and position bed mechanism 108 down upon the tunnel floor F. At the same time it urges cuttings 120 upward to ensure compaction at the roof T of the excavation.

Figure 4:
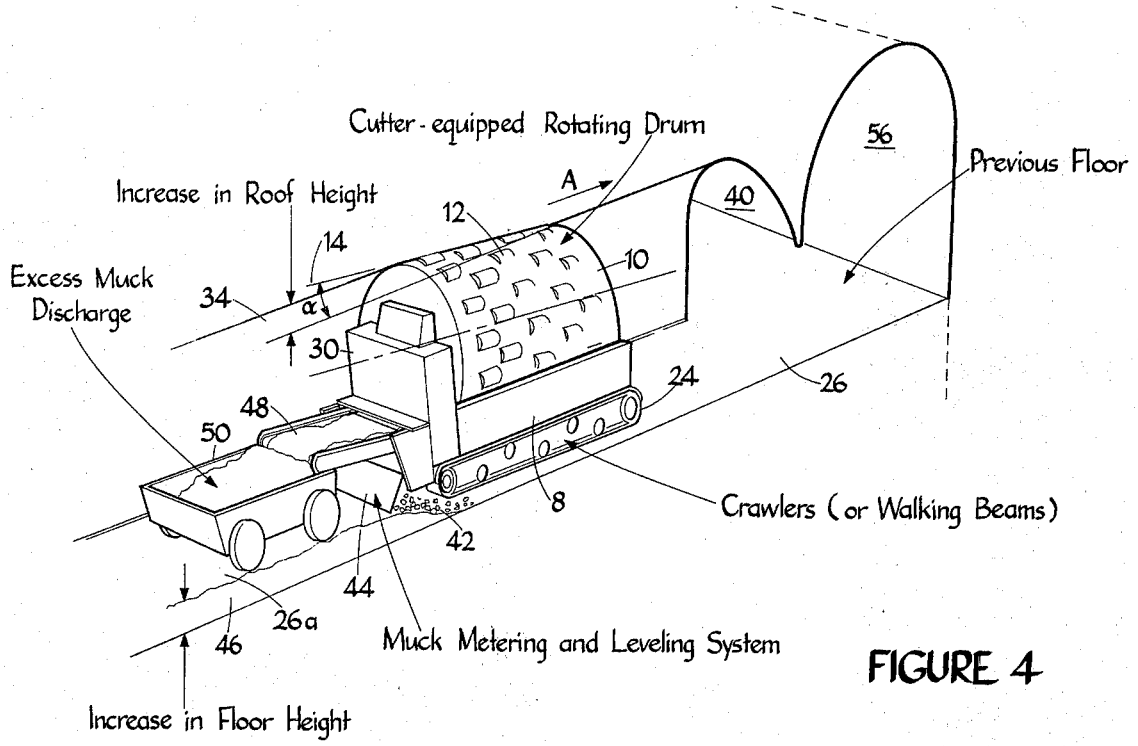

Referring to FIG. 4 another single sided machine is illustrated, in this case particularly suited for upward progression of the excavation. Parts of identical function as those of the embodiment of FIG. 1 are assigned the same numbers as in FIG. 1.

Figure 5:
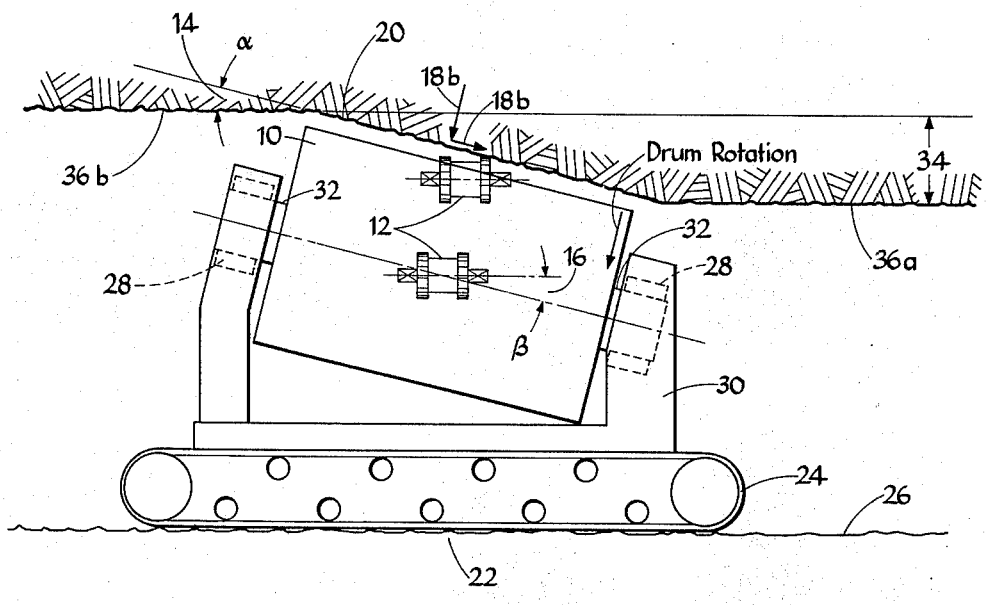
FIG. 5 is a partial side view thereof.

For advancing the machine of FIGS. 4 and 5, the machine travels on crawlers 24 on the floor 26 of tunnel 40. Cuttings (muck) from the excavation zone will fall on floor 26 and these are guided to the rear of the machine by suitable baffles that catch most cuttings before they fall on floor 26. At the rear they are leveled by a metering and leveling system 42, consisting of an adjustable scraper blade 44. This deposition of cuttings produces a new floor 26*a* at height 46 above the original floor 26. If the next excavating pass of the machine is to advance an increment 34 into the roof, clearly the floor height increment 46 should equal the desired roof increment 34.

Typically, excavated material expands or "swells" to occupy a greater volume in the crushed condition than in the original solid form — an increase in volume of about 30% is common. Thus, an excess volume of crushed material will be created with each pass. Excess cuttings are conveyed from under the drum 10 (where they are caught directly on the extension of conveyor 48 before they reach the floor) by conveyor 48 and dumped into a trailer 50, pulled by the machine. Alternatively if the excavation is long and the approximately 30% excess cuttings volume would require too large a trailer, cuttings may be dumped from conveyor 48 to an auxiliary extendable conveyor (not shown) on which they would be carried out of the heading.

It is desirable to make many passes of the machine such that the entire operation climbs on a muck pile placed in layers with each pass leveled by the system 42, and compacted by repeated passage of the machine. In certain instances it is inconvenient to withdraw the machine after each pass to make all excavation passes in the same direction.

Figure 6:
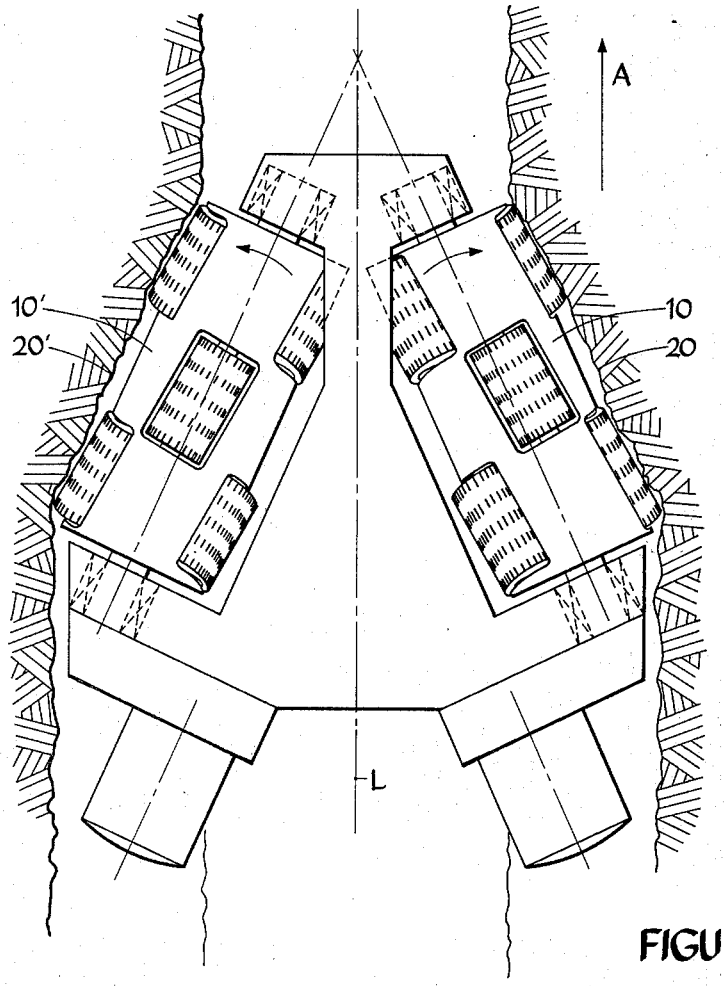
FIG. 6 illustrates a 2 sided machine according to the invention and FIGS. 7 and 8 illustrate a mining scheme employing the machine of FIG. 6.

Referring to FIG. 6 the two sided machine has drums 10, 10′ engaging the vertical sides 20 and 20′ of a horizontal tunnel, each drum having the relation to its respective side as described above, the axis of the drums intersecting at a point forward of the machine, in the direction of machine advance A.

For a second pass, the drums 10, 10′, and the half frames on which they are mounted are separated further apart by insertion of a spacer at the midline L.

Figure 7:
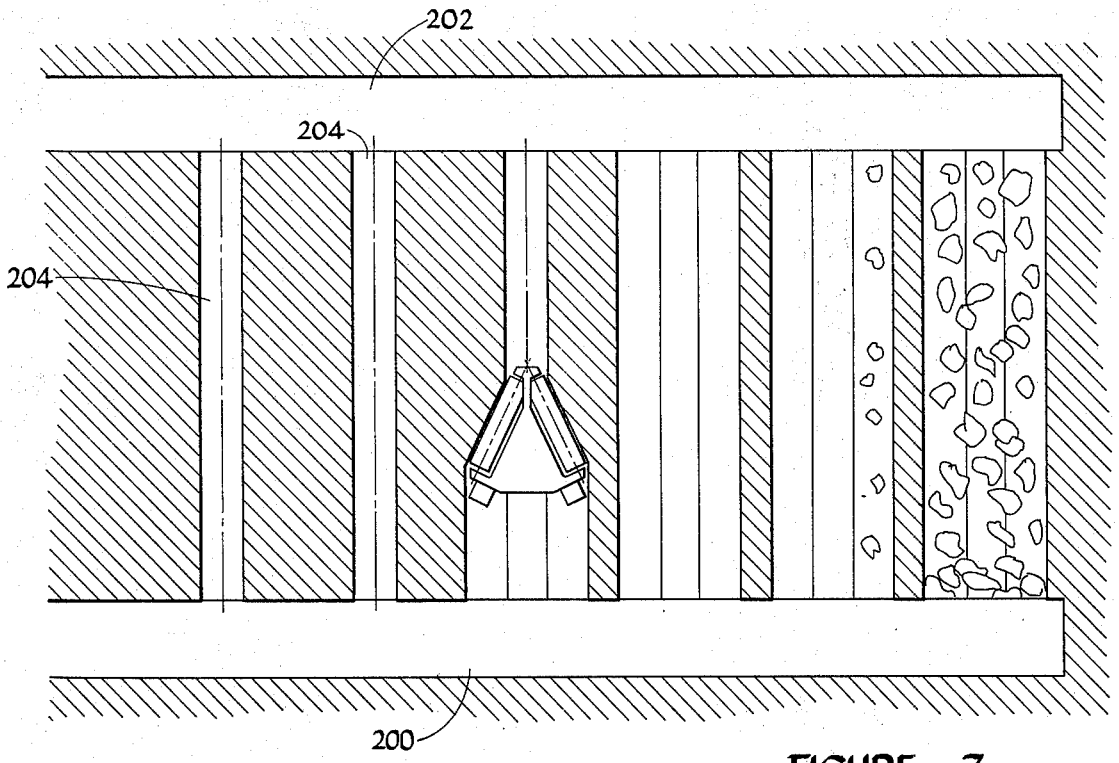
Figure 8:
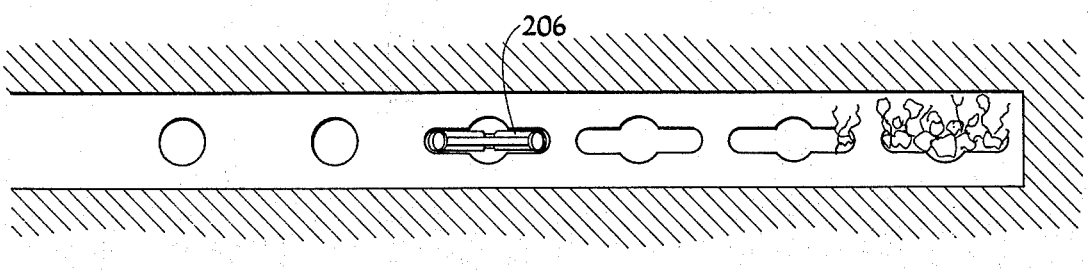
Figure 9:
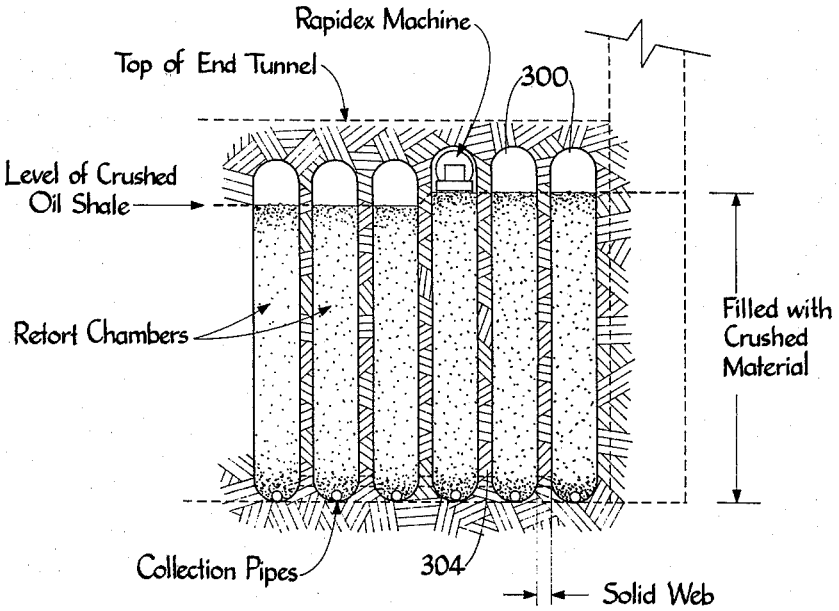
FIG. 9 is a transverse vertical cross-section of a series of vertical chambers formed according to the invention.

In FIGS. 7 and 8, between horizontal tunnels 200 and 202, horizontal pilot holes 204 are bored and the machine progresses into the holes to form enlarged tunnels 206. It is possible to remove a thin vein of valuable ore by this means.

Referring to FIGS. 9–13, the machine of FIG. 4 is employed to form vertical flow-directing chambers 300 filled with broken rock.

With each pass of the machine a portion, perhaps 30%, of the muck is removed, with the remainder left on the floor of the heading. The machine then climbs on top of the muck, makes another pass, and so on. Each time, enough muck is extracted to account for the swell factor so that the machine, passing back and forth, gradually excavates upward, against the top wall of the tunnel, climbing on its own muck pile, and leaving behind a vertical slot in the shale formation, filled with fractured and compacted oil shale. The machine may travel directly on the muck, on crawlers or walking beams for example, or it may travel on a rail (the rail capable of lifting itself with the growing muck pile).

Figure 10:
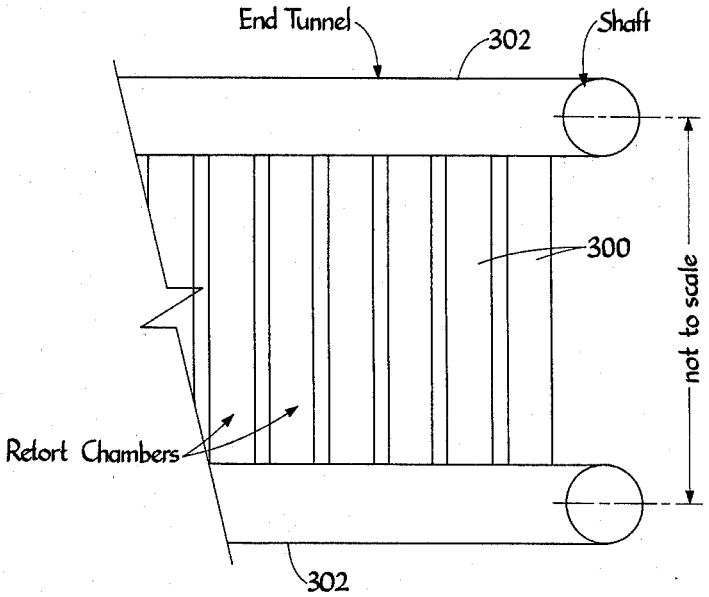
FIG. 10 is a plan view thereof.
Figure 11:
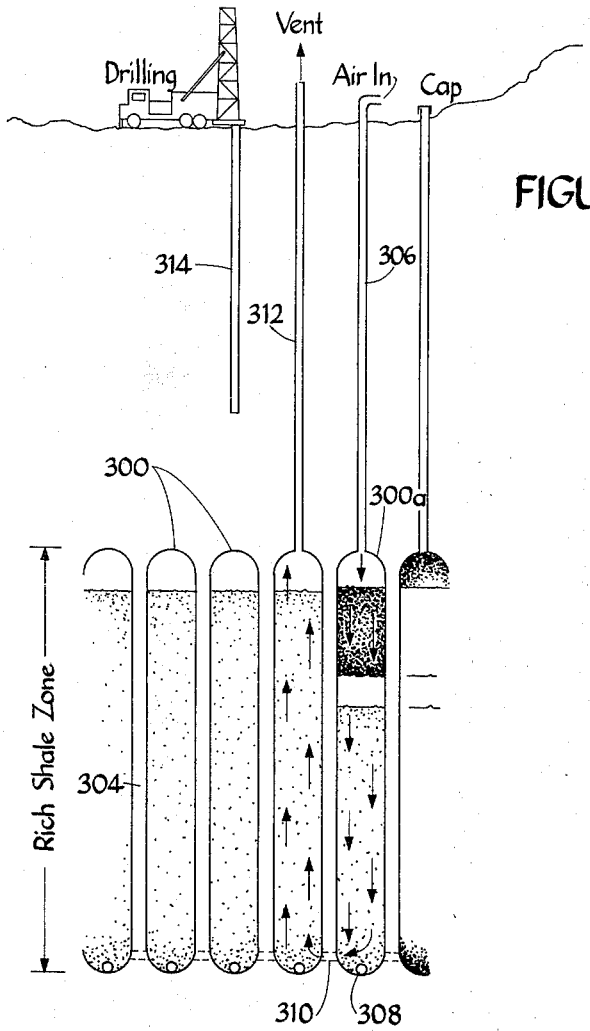
FIG. 11 is similar to FIG. 9 illustrating the extraction process and FIGS. 12 and 13 are perspective views further illustrating the process.
Figure 13:
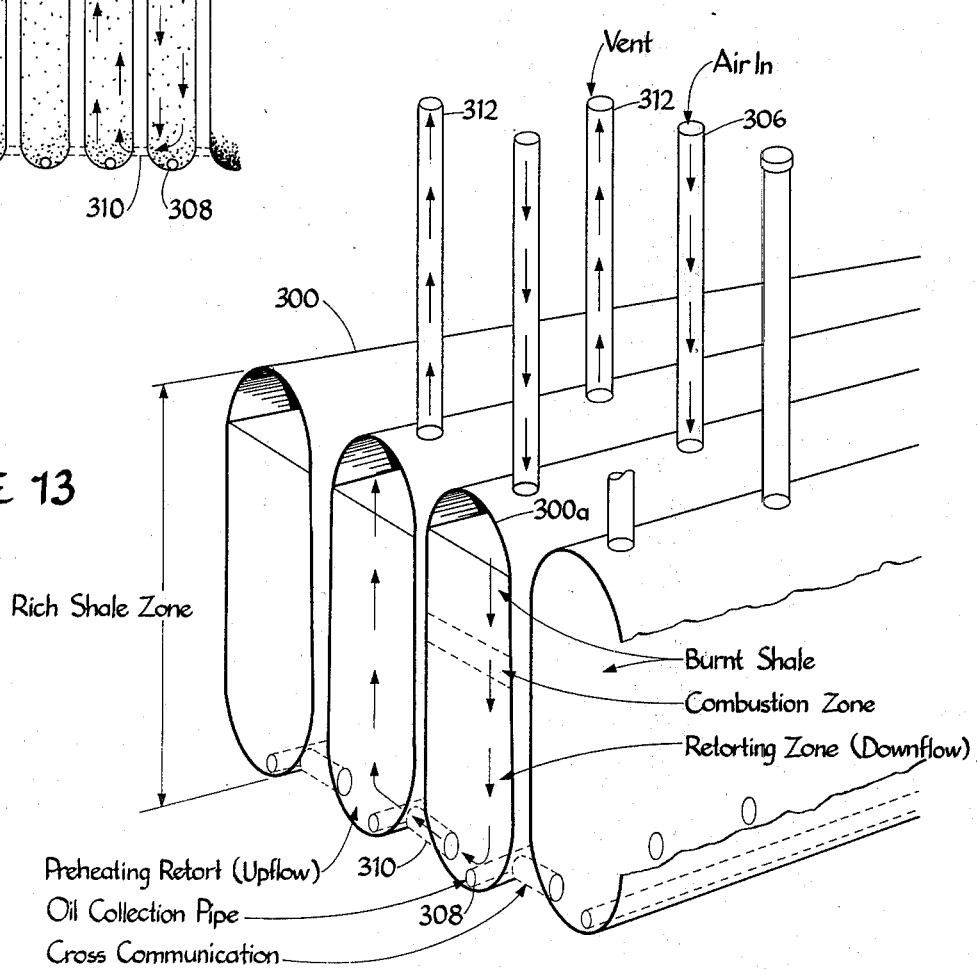
Figure 12:
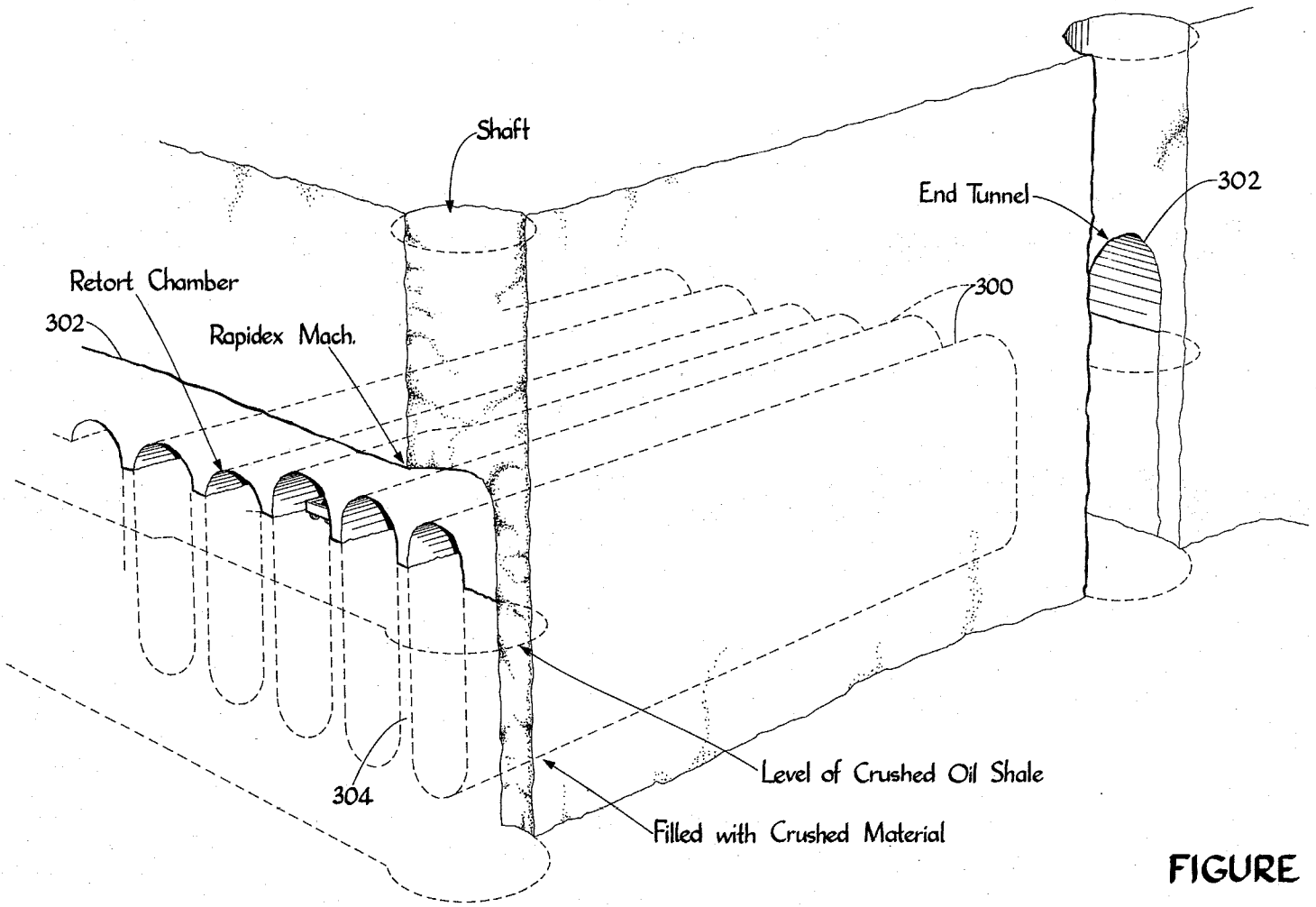

Referring to FIG. 10 the mining layout begins at the bottom of a thick seam with tunnels in a pattern like a football field — the "side lines" 302 for access and to provide turn-around space, and the "yard lines" 300 arranged to provide a series of closely spaced, long, tall, vertical retort chambers of crushed shale separated by relatively thin webs 304 of unbroken shale. For example, the retort chambers may be 10 feet wide and several hundred yards long by as deep as the rich shale zone. The unbroken webs 304 may be about 3 feet thick. Each web is well supported by compacted material on both sides as excavation proceeds. The entire pattern is excavated upward at a uniform rate so that the surface of the muck remains about level and no tall empty chambers are formed.

The chambers provide vertical retorts with a regenerative feature. When all excavations are completed, a fire is started in the top of the end retort 300*a* and fed by air blown in from the top, down open drill holes 306. Hot combustion gases flow downward in that retort, heating the crushed shale and driving "oil" downward (with gravity assistance) to a collection pipe 308 placed at the bottom of the retort when it was formed. The hot gases pass over into the next retort through holes 310 in the base of the web formed in the beginning, thence upward through crushed shale to the surface through open drill holes 312. The process is regenerative in that both heat and condensable effluent are deposited in the second retort.

When combustion nears the bottom of the first retort, air feed is stopped and the fire put out, capping the drill holes 306 of the first chamber. The process is then repeated, starting with fire in the top of the (now preheated) second retort, with hot gases flowing downward, over into the third retort, and upward to the surface through drill hole 314 shown being formed by a drill rig in FIG. 15. The unbroken webs 304 serve to direct the flow, but they need not be perfect seals. If thin enough, they will also give up their shale oil.

The end tunnels 302 provide a large "short circuit" that would spoil the desired down-flow, up-flow pattern in adjacent retorts 300 and, therefore, these must be sealed. This can be done as excavation proceeds since the end tunnels 302 will be excavated and filled at the same rate that the retorts 300 are excavated.

Placement of the seal is accomplished by pouring grout, for example a thin concrete, across the floor of the end tunnel between retort chambers at 310, FIG. 14. If the grout is known to penetrate say 3 feet into the crushed shale, then this operation should be carried out each time the end tunnel floor level has risen 3 feet.

At the top of the excavation a wall is constructed from the floor of the end tunnel to its roof. This wall could be of any handy material, including grout filled rushed shale placed between simple forms.

Other embodiments of the various aspects and features of the invention will occur to those skilled in the art.

I claim:

1. A side excavating machine comprising a rotatably driven cylindrical drum adapted to advance generally endwise along a pre-existing working face, but angled so that trailing portions of the drum project beneath the plane of the pre-existing face, said drum having a distribution of rock cutting rollers on its cylindrical surface which are freely rotatable about their rolling axes, said rolling axes being fixed in a predetermined relation to the axis of said drum defining a small forward skew angle, a frame adapted to advance along said working face, said cylindrical drum being rotatably mounted by bearings on said frame with the drum axis lying at a small acute angle to the direction of advance so that said trailing portions of the drum excavate rock as the frame advances along the face, the major component of rock-cutting forces thereby applied to the drum being normal to the direction of advance of said frame, means to provide side reaction force to said frame corresponding to said major component of rock-cutting forces, and said fixed axis skewed rollers in rolling action upon the rock adapted to generate a force assisting in the forward advance of said cutting rollers.

2. The machine of claim 1 carrying a single such rotatable drum, said frame provided with a tractive device for advancing said frame along said working face.

3. The machine of claim 1 having a pair of such rotatable drums mounted upon said frame, said drums mounted at opposite small acute angles relative to the direction of advance of said frame, said drum providing said side reaction force for the other.

4. The machine of claim 1 adapted for substantially horizontal advance of the excavation including a bed mechanism extending a substantial length of the working face constructed to retain cuttings, said drum and frame mounted upon a carrier which movably bears upon said bed mechanism whereby reactive forces for maintaining said drum against the working face are provided by said bed mechanism acting against cuttings.

5. The machine of claim 4 including transfer means for transferring cuttings from the excavation zone to a position behind said bed mechanism.

6. The machine of claim 5 wherein said bed mechanism includes a cover upon which cuttings are temporarily delivered and means for pushing cuttings rearwardly to join prior cuttings, in space provided with advance of said bed mechanism.

7. The machine of claim 6 wherein said bed mechanism includes a rail assembly and a cover having a face positioned to press against the respective vertical side of the tunnel formed by cuttings, jack means interposed between said cover and rail to advance the rail toward the excavation face by reaction against said cuttings, and means thereafter for drawing said cover forwardly from compacted cuttings to provide a space to receive cuttings previously stored upon said cover.

8. The machine of claim 7 wherein the face of said cover slopes downwardly, rearwardly.

* * * * *